US006332066B1

(12) United States Patent
Yanagawa

(10) Patent No.: US 6,332,066 B1
(45) **Date of Patent: *Dec. 18, 2001**

(54) MULTICOLOR IMAGE FORMING METHOD AND APPARATUS USING AN INTERMEDIATE TRANSFER BELT AND APPARATUS HAVING PLURAL DEVELOPING UNITS FOR THE SAME

(75) Inventor: Nobuyuki Yanagawa, Kanagawa (JP)

(73) Assignee: Ricoh Company, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/951,521

(22) Filed: Oct. 16, 1997

(30) Foreign Application Priority Data

| | | |
|---|---|---|
| Oct. 16, 1996 | (JP) | 8-273350 |
| Nov. 25, 1996 | (JP) | 8-313654 |
| Sep. 26, 1997 | (JP) | 9-261753 |

(51) Int. Cl.[7] ..... G03G 15/01

(52) U.S. Cl. ..... 399/302; 399/107; 399/308

(58) Field of Search ..... 399/107, 110, 399/223, 225, 112, 298, 299, 300, 302, 306, 308

(56) References Cited

U.S. PATENT DOCUMENTS

| | | | | |
|---|---|---|---|---|
| 4,515,460 | * | 5/1985 | Knechtel | 399/302 |
| 4,593,991 | * | 6/1986 | Aoki et al. | 399/227 |
| 4,615,607 | | 10/1986 | Yanagawa et al. . | |
| 4,875,079 | * | 10/1989 | Bisaiji et al. | 399/41 |
| 4,987,455 | * | 1/1991 | Lubberts | 399/299 |
| 5,121,171 | * | 6/1992 | Knapp | 399/299 |
| 5,526,107 | * | 6/1996 | Bronstein | 399/299 |
| 5,532,812 | * | 7/1996 | Choi et al. | 399/228 |
| 5,629,761 | * | 5/1997 | Theodoulou et al. | 399/307 |
| 5,752,137 | * | 5/1998 | Haneda | 399/223 |
| 5,805,967 | * | 9/1998 | De Bock et al. | 399/299 |
| 5,915,074 | | 6/1999 | Shimazawa et al. | 358/1.4 |

FOREIGN PATENT DOCUMENTS

| | | | |
|---|---|---|---|
| 63-292162 | * | 11/1988 | (JP) . |
| 2-12273 | | 1/1990 | (JP) . |
| 3-251860 | * | 11/1991 | (JP) . |
| 4-27973 | * | 1/1992 | (JP) . |
| 4-204871 | | 7/1992 | (JP) . |
| 4-221974 | | 8/1992 | (JP) . |
| 4-284468 | | 10/1992 | (JP) . |
| 8-160697 | | 6/1996 | (JP) . |
| 8-305120 | | 11/1996 | (JP) . |
| 9-106135 | * | 4/1997 | (JP) . |
| 9-244329 | * | 9/1997 | (JP) . |

* cited by examiner

*Primary Examiner*—Quana M. Grainger
(74) *Attorney, Agent, or Firm*—Oblon, Spivak, McClelland, Maier & Neustadt, P.C.

(57) ABSTRACT

In a multicolor image forming apparatus, a first and a second image forming unit are arranged along an intermediate transfer belt and spaced from each other by a predetermined distance. The first image forming unit includes a single photoconductive drum, a developing device for developing a latent image formed on the drum with toner of first color, and a developing device for developing it with toner of second color. The second image forming unit includes a single photoconductive drum, a developing device for developing a latent image formed on the drum with toner of third color, and a developing device for developing it with black toner.

49 Claims, 9 Drawing Sheets

70
68
84
83
P
87
86
79
78-2
76-2
77-2
72
400
401
402
81
75-2
85
b
89
88
301
66
302
300
404
403
a
303
304
II
74
80
78-1
76-1
77-1
90
101
102
100
73
75-1
201
102a
202
91
104
103
82
204
200
203
I

MULTICOLOR IMAGE FORMING METHOD AND APPARATUS USING AN INTERMEDIATE TRANSFER BELT AND APPARATUS HAVING PLURAL DEVELOPING UNITS FOR THE SAME

BACKGROUND OF THE INVENTION

The present invention relates to an image forming method for forming each of toner images of different colors on a respective photoconductive drum or similar image carrier, transferring the toner images to an intermediate transfer belt, and transferring them from the belt to a recording medium, and an apparatus for practicing the same.

A color copier, color facsimile apparatus, color printer or similar color image forming apparatus is extensively used today. Some different types of image forming apparatuses are known in the art, as follows.

(1) A color image forming apparatus includes a plurality of photoconductive drums arranged around a single image transfer drum. Color images formed on the photoconductive drums are directly transferred to a paper or similar recording medium wrapped around the image transfer drum. For example, latent images respectively formed on the photoconductive drums are developed by two developing devices, as taught in Japanese Patent Laid-Open Publication No. 2-12273 by way of example. Specifically, a first developing unit assigned to a first photoconductive element has a yellow toner and a cyan toner developing section. A second developing unit assigned to a second photoconductive element has a magenta toner and a yellow toner developing section. Color images formed on the photoconductive drums by the first and second developing devices are transferred to a paper wrapped around the image transfer drum. This type of apparatus as the following problem. The first and second photoconductive drums are spaced from each other. Therefore, if either of the two photoconductive drums are arranged around the transfer drum with the same orientation, they each contact the transfer drum at a different position (image transfer position). Consequently, the first developing device including a first charger in addition to the first photoconductive drum and developing device and the second developing device including a second charger in addition to the second photoconductive drum and developing device are not replaceable with each other and must be prepared independently of each other.

(2) A color image forming apparatus includes a plurality of image forming devices arranged side by side along an image transfer belt which supports and conveys a paper, as shown in FIG. 6 of the above Laid-Open Publication No. 2-12273. The problem with this type of apparatus is that means for causing the transfer belt to support the paper is required, and in addition only papers of particular sizes corresponding to the transfer belt are usable.

(3) A color image forming apparatus includes four developing devices arranged around a part of a single photoconductive drum, as disclosed in, e.g., Japanese Patent Laid-Open Publication No. 8-160697. The four developing devices each develops a respective latent image formed on the drum. The resulting toner images are transferred to an intermediate transfer belt partly contacting the drum. Subsequently, the toner images are transferred from the belt to a paper. The problem with this type of apparatus is that although the four developing devices arranged around the drum may be identical in configuration, they each is held in a particular position with respect to the drum. As a result, such developing devices are not replaceable with each other.

In addition, the number of copies or printings available with this apparatus for a unit time is limited.

(4) A color image forming apparatus includes a single image transfer belt and four photoconductive drums. A single developing unit is assigned to each of the four photoconductive drums. Color images transferred from the photoconductive drums to the image transfer belt are transferred to a paper. Although a relatively high image forming speed is achievable with this type of apparatus, one image forming unit including a charger must be assigned to each of the drums, scaling up the entire apparatus.

SUMMARY OF THE INVENTION

It is therefore an object of the present invention to provide a multicolor image forming method using an intermediate transfer belt and capable of obviating the problems discussed above, and an apparatus for practicing the same.

A multicolor image forming apparatus of the present invention includes at least first and second image forming units spaced from each other by a preselected distance. The first image forming unit includes a first image carrier and a first developing device for developing a latent image electrostatically formed on the image carrier by use of a developer of first color. The second image forming unit includes a second image carrier and a second developing device for developing a latent image electrostatically formed on the image carrier by use of a developer of second color. Toner images respectively formed on the first and second image carriers by the first and second developing devices are transferred to an intermediate transfer belt. The first and second image forming units are arranged along a single run of the intermediate transfer belt. A transfer device transfers the toner images from the intermediate transfer belt to a recording medium.

Also, an image forming method of the present invention forms each of toner images of at least three primary colors A, B and C on a respective image carrier, transfers the toner images to an intermediate transfer belt, and transfers the toner images from the intermediate transfer belt to a recording medium. A first and a second image forming units are arranged along a single run of the intermediate transfer belt and spaced from each other by a preselected distance. The first image forming unit is caused to transfer an A color toner image to the intermediate transfer belt. The second image forming unit is caused to transfer a B color toner image to the intermediate transfer belt over the A color toner image. The first image forming unit is caused to transfer a C color toner image to the intermediate transfer belt over the resulting A/B color toner image to thereby form a color image. A transfer device is caused to transfer the color image to a recording medium.

BRIEF DESCRIPTION OF THE DRAWINGS

The above and other object, features and advantages of the present invention will become apparent from the following detailed description taken with the accompanying drawings in which.

DESCRIPTION OF THE PREFERRED EMBODIMENTS

Preferred embodiments of the multicolor image forming apparatus in accordance with the present invention will be described hereinafter with reference to the accompanying drawings.

1st Embodiment

Figure 1:
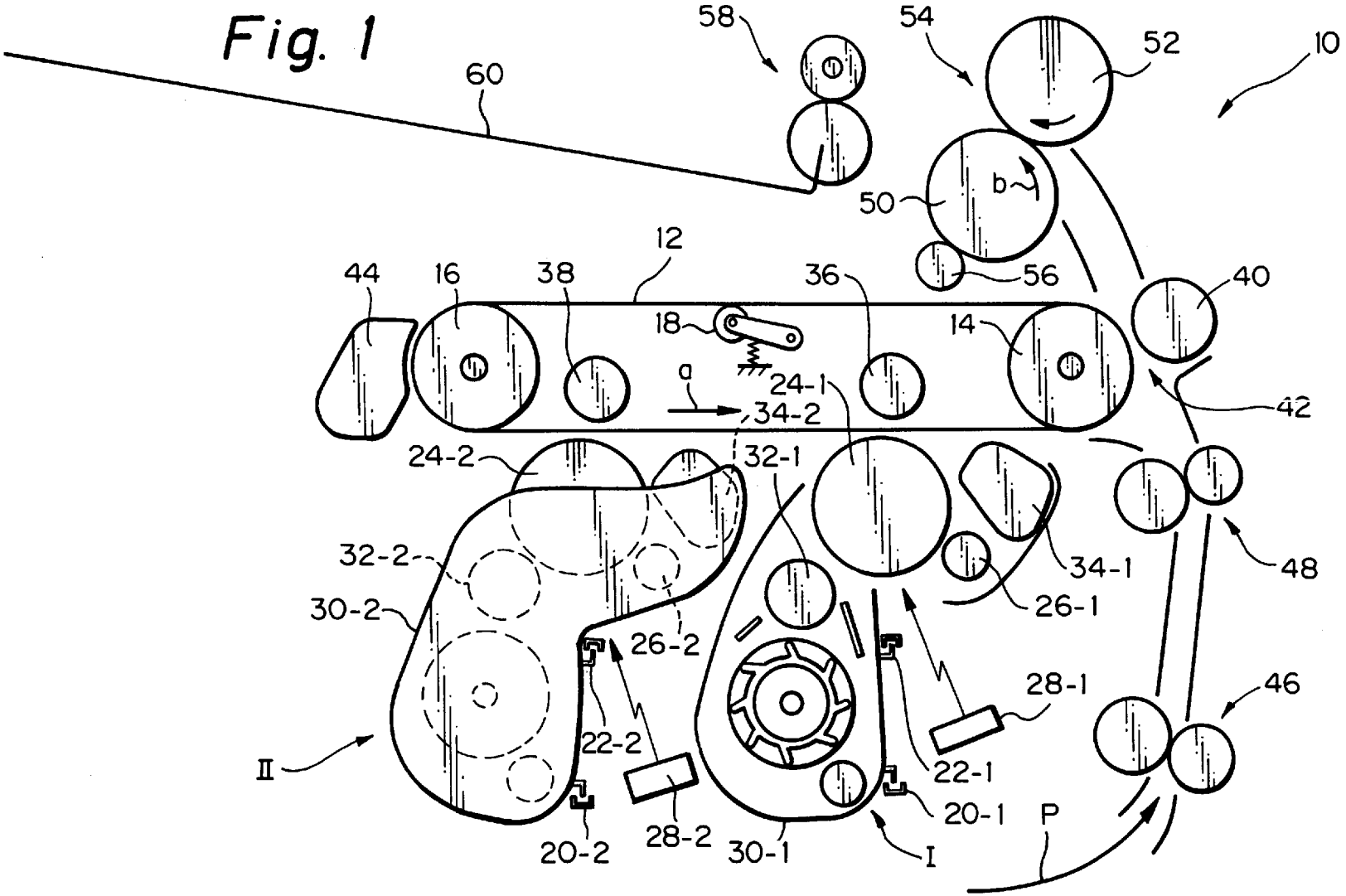
FIG. 1 shows a first embodiment of the multicolor image forming apparatus in accordance with the present invention.

Referring to FIG. 1, a color image forming apparatus embodying the present invention is shown and generally designated by the reference numeral 10. As shown, the apparatus 10 includes an intermediate transfer belt 12 (simply belt hereinafter) passed over a drive roller 14 and a driven roller 16 and rotatable in the direction indicated by an arrow a. A tension roller 18 applies an adequate tension to the belt 12. A first and a second image forming unit I and II, respectively, are arranged below and along the lower run of the belt 12 and spaced from each other by a predetermined distance.

A pair of channel-like guides 20-1 are provided on the body of the apparatus 10 while a pair of rails 22-1 are provided on the first image forming unit I and slidably engaged with the guides 20-1. The image forming unit I is therefore removably mounted to the the apparatus body. The image forming unit I includes a photoconductive drum or image carrier implemented as a drum 24-1, a charger 26-1, a writing unit 28-1, a developing device 30-1 assumed to store a black developer, and a cleaning device 34-1. The charger 26-1 uniformly charges the surface of the drum 24-1. The writing unit 28-1 scans the charged surface of the drum 24-1 with a beam in accordance with an image signal representative of a document image. The developing device (black developing device hereinafter) 30-1 includes a developing roller 32-1. The image forming unit I is slidable in the axial direction of the drum 24-1 and can be pulled out of the apparatus body by being pulled toward the front of the apparatus body.

The second image forming unit II is identical in configuration with the first image forming unit and includes a drum 24-2, a charger 26-2, a writing unit 28-2, a developing unit 30-2 assumed to store a red developer and 5 including a developing roller 32-2, and a cleaning device 34-2. The image forming unit II is removably mounted on the apparatus body in the same position as the image forming unit I. Let the developing device 30-2 be referred to as a red developing device hereinafter.

The rotation of the drums 24-1 and 24-1 included in the image forming units I and II, respectively, is synchronous to the movement of the belt 12. The drums 24-1 and 24-2 are moved at precisely the same peripheral speed as the belt 12. The chargers 26-1 and 26-2 may be replaced with corona dischargers or charging devices using brushes.

The charger 26-1 and writing device 28-1 cooperate to form an electrostatic latent image on the drum 24-1 by a conventional method. This is also true with the charger 26-2 and writing unit 28-1 and 28-2. The developing devices 30-1 and 30-2 respectively develop the latent images formed on the drums 24-1 and 24-2 by using the developing rollers 32-1 and 32-2. The developing devices 30-1 and 30-2 each have a respective agitator, toner replenishing device, and so forth and may be implemented as, e.g., a color developing device taught in Japanese Patent Laid-Open Publication No. 8-160697.

A first and a second transfer roller 36 and 38, respectively, face the drums 24-1 and 24-2, respectively. The transfer rollers 36 and 38 are movable into and out of contact with the drums 24-1 and 24-2 with the intermediary of the belt 12. A bias voltage for image transfer is applied to each of the transfer rollers 36 and 38. A transfer roller 40 is movable into and out of contact with the drive roller 14 with the intermediary of the belt 12 and applied with a bias voltage for image transfer.

Usually, the drums 24-1 and 24-2 are slightly spaced below the belt 12 while the transfer rollers 36 and 38 are spaced above the belt 12. At the time of transfer of a toner image from the drum 24-1 or 24-2 to the belt 12, the transfer roller 36 and/or the transfer roller 38 presses the belt 12 against the drum 24-1 and/or the drum 24-2, as will be described specifically later.

The drive roller 14 and transfer roller 40 define an image transfer position 42. The transfer rollers 36 and 38 playing the role of image transfer devices may be replaced with corona dischargers or brush type chargers, if desired. A belt cleaning device 44 is movable into and out of contact with the driven roller 16 with the intermediary of the belt 12 so as to clean the surface of the belt 12.

A paper feed device, not shown, is located below the image forming units I and II in order to feed papers or similar recording media one by one to the right, as viewed in FIG. 1. A paper P fed from the paper feed device is conveyed to the image transfer position 42 by a feed roller pair 46 and a registration roller pair 48. A fixing device 54 is disposed above the image transfer position 42 and made up of a heat roller 50 and a press roller 52. The heat roller 50 is rotated in the direction indicated by an arrow b while the press roller 52 is pressed against and rotated by the heat roller 50. A roller 56 may be pressed against the heat roller 50 in order to apply an anti-offset liquid to the roller 50. An outlet roller pair 58 is positioned downstream of the fixing device 54 in the direction in which the paper P is conveyed. The paper P coming out of the fixing unit 54 is discharged to a tray 60 by the outlet roller pair 58.

The apparatus 10 having the above construction will be operated as follows. Assume that a copy or a printing with black characters and red characters existing together is desired. Then, the charger 26-2 and writing device 28-2 of the second image forming unit II form a latent image representative of the red characters on the drum 24-2. The red developing device 30-2 develops the latent image with the red developer to thereby produce a red toner image. The red toner image is transferred from the drum 24-2 to the belt 12.

Likewise, the charger 26-1 and writing device 28-1 of the first image forming unit I form a latent image representative of the black characters on the drum 24-1. The black developing device 30-1 develops the latent image with the black developer to thereby produce a black toner image. The black toner image is transferred to a position of the belt 12 where the black toner image will not overlap the red toner image existing on the belt 12.

When the resulting red/black toner image is almost fully formed on the belt 12 by the first transfer roller 36, the paper P fed from the sheet feed device is driven to the image transfer position 42 by the registration roller pair 48. As a result, the red/black toner image is transferred from the belt 12 to the paper P. The toner image is fixed on the paper P by the fixing device 54 and then driven out to the tray 60 by the outlet roller pair 58. After the image transfer, the belt cleaning device 44 removes toner left on the belt 12.

Assume that a black or a red underline is present below some of the black characters on a document. Then, the above embodiment allows the underline to be formed in red. Also, the embodiment allows a mark or a pattern existing on a document together with characters to be formed in red.

Figure 2:
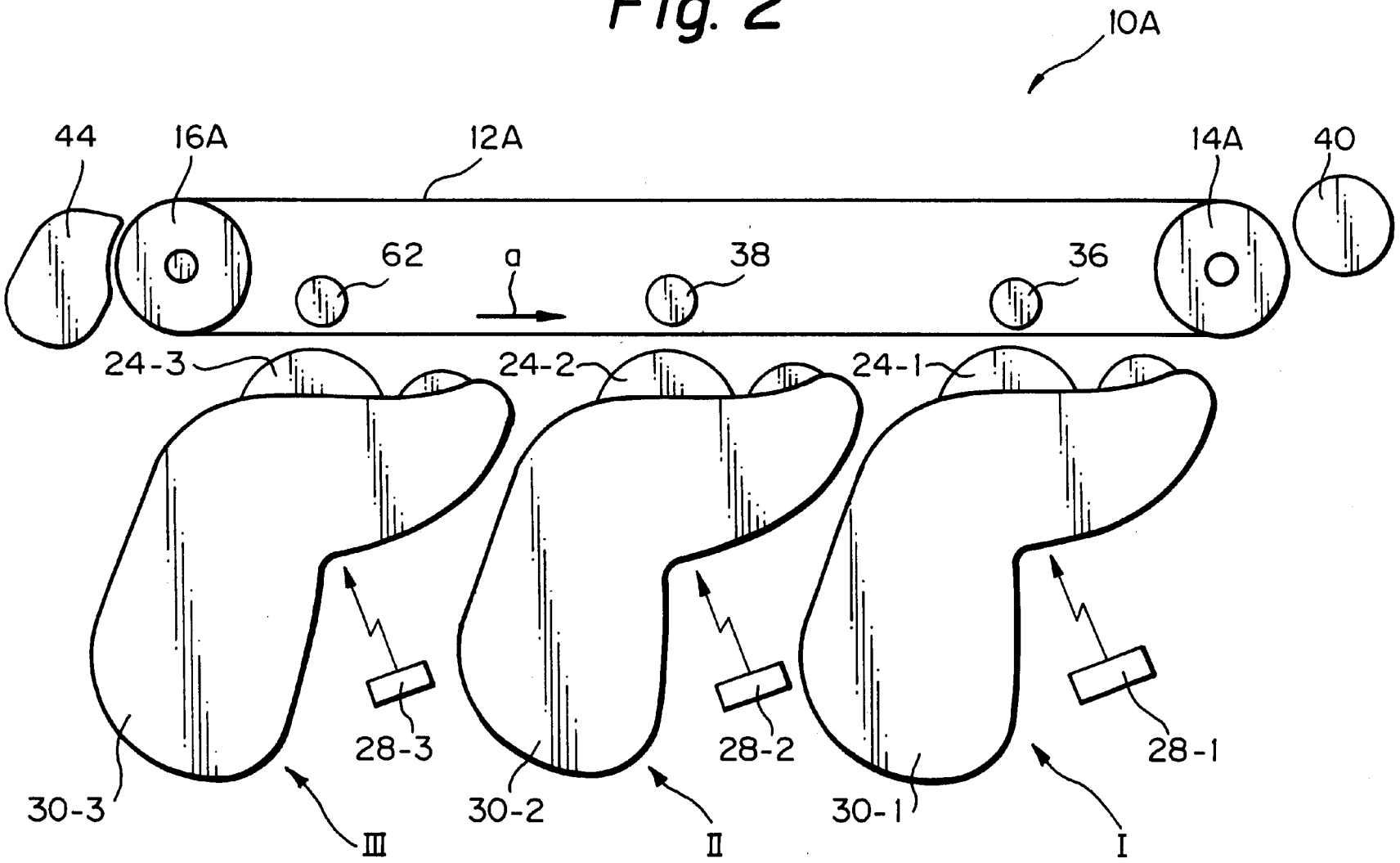
FIGS. 2 and 3 each shows a particular modification of the first embodiment.

FIG. 2 shows a modification of the first embodiment. As shown, an image forming unit, generally 10A, has a third image forming unit III in addition to the first and second image forming units I and II. The third image forming unit III is identical in configuration with the first image forming unit I and removably mounted to the apparatus body in the same position as the first and second image forming units I and II. An intermediate transfer belt 12A is passed over a drive roller 14A and a driven roller 16A and rotated by the drive roller 14A in the direction indicated by an arrow a.

Assume that a copy or a printing with black characters, red characters and blue characters existing together is desired, and that the third developing unit III stores a blue developer therein. A latent image representative of the blue characters is formed on a drum 24-3 included in the third image forming unit III by a writing unit 28-3. A developing device 30-3 develops the latent image to thereby produce a blue toner image. The blue toner image is transferred to the belt 12A by a third transfer roller 62. Likewise, a latent image representative of the red characters is formed on the drum 24-2 and then developed by the developing device 30-2. The resulting red toner image is transferred by the second transfer roller 38 to a position of the belt 12A where the red toner image will not overlap the blue toner image existing on the belt 12A. Further, a latent image representative of the black characters is formed on the drum 24-1 and then developed by the developing device 30-1. The resulting black toner image is transferred by the first transfer roller 36 to a position of the belt 12A where the black toner image will not overlap the red toner image existing on the belt 12A. The composite blue/red/black toner image is transferred from the belt 12A to the paper P by the transfer roller 40 in the same manner as in the first embodiment. After the image transfer, the cleaning device 44 removes toner left on the belt 12A.

Figure 3:
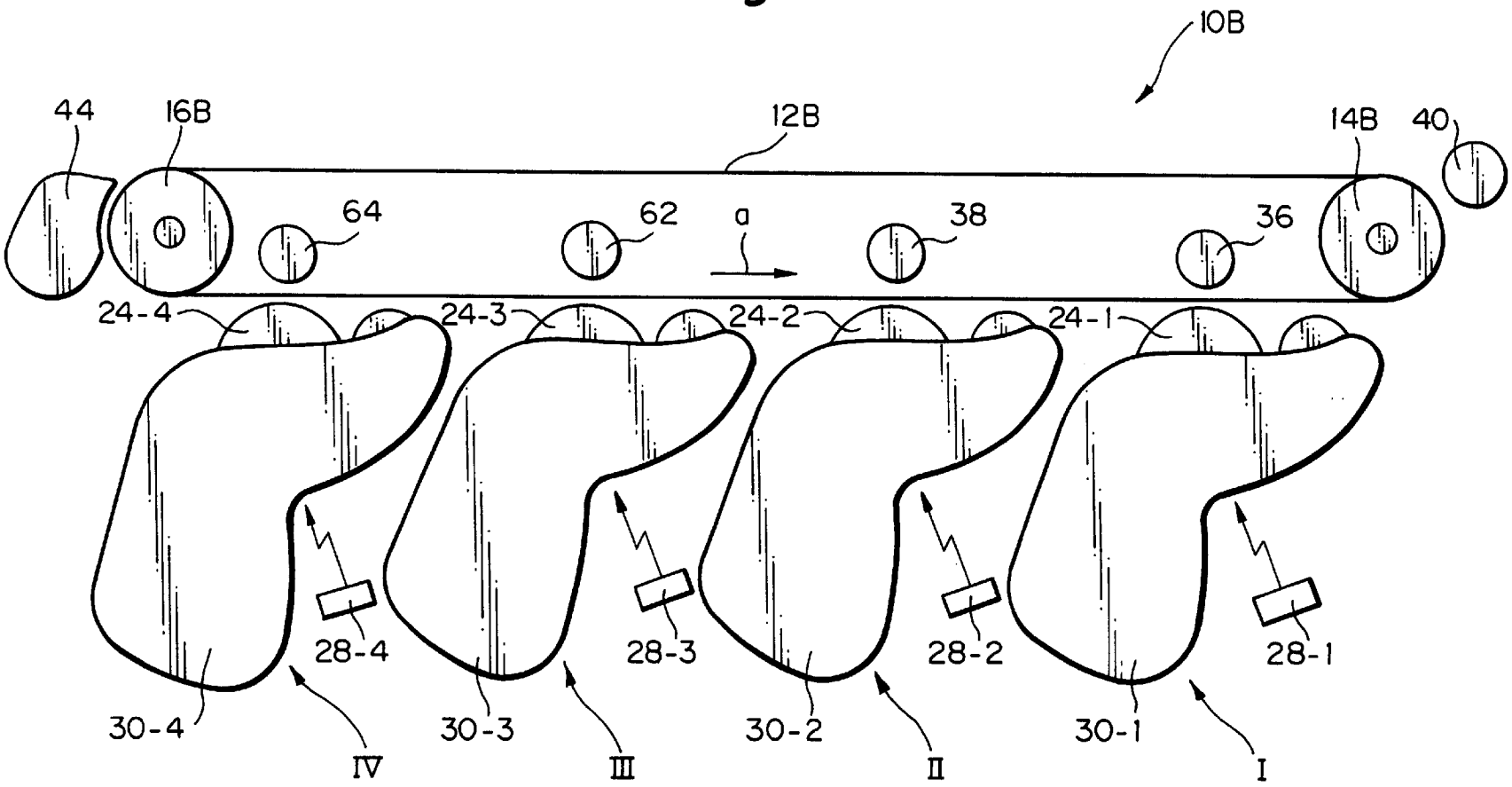

FIG. 3 shows another modification of the first embodiment. As shown, an image forming apparatus, generally 10B, has a fourth image forming unit IV in addition to the first, second and third image forming units I, II and III. The fourth image forming unit IV is identical in configuration with the first image forming unit I and removably mounted to the apparatus body in the same position as the unit I. The fourth image forming unit IV includes a drum 24-2, a writing device 28-4, and a developing unit 30-4. In this modification, the developing units 30-1 through 30-4 of the image forming units I through IV are assumed to respectively store a developer implemented by black (Bk) toner, a developer implemented by cyan (C) toner, a developer implemented by magenta (M) toner, and a developer implemented by yellow (Y) toner. An intermediate transfer belt 12B is passed over a drive roller 14B and a driven roller 16B and driven by the drive roller in the direction indicated by an arrow a.

The operation of the modification shown in FIG. 3 is as follows. Assume that a full-color image is to be copied or printed. Then, the writing devices 28-4 through 28-1 of the image forming units IV through I each forms a respective latent image on associated one of the drums 24-4 through 24-1. The developing devices 30-4 through 30-1 each develops the respective latent image with one of the Y, M, C and Bk toners stored therein. The resulting toner images are sequentially transferred to the belt 12B one above the other, forming a full-color image. The full-color image is transferred from the belt 12B to the paper P in the same manner as in the first embodiment. The belt cleaning device 44 removes the toner left on the belt 12B after the image transfer.

On the other hand, assume that a copy or a printing with black characters and red characters is desired. Then, a magenta toner image formed on the drum 24-3 of the third image forming unit III is transferred to the belt 12B over a yellow toner image already transferred from the drum 24-4 of the fourth image forming unit IV, thereby forming a red image on the belt 12B. Subsequently, a black toner image formed by the first transfer unit I is transferred to a position of the belt 12B where the black toner image will not overlap the red image.

Further, assume a copy or a printing with black characters and blue characters is desired. Then, a cyan toner image formed on the drum 24-2 of the second image forming unit II is transferred to the belt 12B over a magenta toner image already transferred from the drum 24-3 of the third image forming unit III, thereby forming a blue image on the belt 12B. Subsequently, a black toner image formed by the first image forming unit I is transferred to a position of the belt 12B where the black toner image will not overlap the blue image.

It will be seen by analogy that by selecting the fourth, second and first image forming units IV, II and I, it is possible to produce a copy or a printing carrying black characters and green characters thereon.

In addition, the image forming units I through IV may be suitably selected in order to enter underlines or marks in a copy or a printing in any desired color.

In the above embodiment and its modifications, the image forming units each having the respective drum and developing device are identical in configuration and arranged along a single run of the intermediate transfer belt at the same intervals. In addition, all the image forming units are mounted to the apparatus body in the same orientation as each other. Therefore, so long as such image forming units are identical in orientation, the above run of the belt may not be horizontal, but may be vertical or even inclined, as desired.

A reading device for reading a document will be used when any one of the embodiment and its modification is applied to an electrophotographic copier, although not shown in the drawings.

Gold toner, silver toner, flesh-color toner and fluorescent color toner, for example, may be used in addition to the red toner, blue toner, three primary color toners and black toner, if desired.

Because all the image forming units are identical in configuration and arranged in the same orientation along a single run of the intermediate transfer belt, the color of the developer to be stored in the individual image forming unit is open to choice. This facilitates the production, assembly and maintenance of the apparatus. In addition, the intermediate transfer belt prevents the apparatus from being increased in size.

2nd Embodiment

Figure 4:
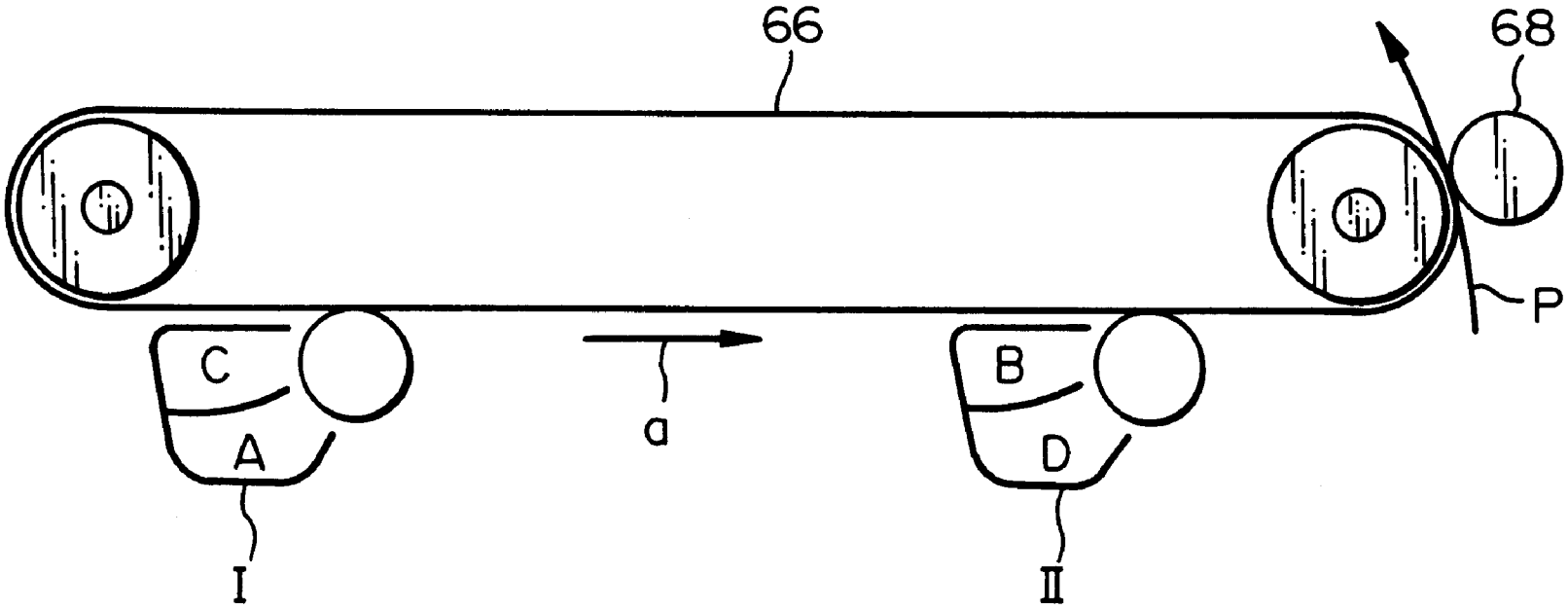
FIG. 4 shows a second embodiment of the present invention.

This embodiment pertains to an image forming method of the kind forming toner images of at least three primary colors A, B and C on image carriers, e.g., photoconductive drums or belts, transferring the toner images to an intermediate transfer belt one above the other, and transferring the resulting color image from the intermediate transfer belt to a paper by an image transfer device. Specifically, as shown in FIG. 4, a first and a second image forming unit I and II are arranged along a single run of an intermediate transfer belt (simply belt hereinafter) 66 and spaced from each other by a preselected distance. The belt 66 is movable in the direction indicated by an arrow a. The image forming units I and II each includes a respective photoconductive drum, charger and developing device. The image forming units I and II sequentially form toner images on the belt 66, as will be described with reference to FIGS. 5 and 6. A color image formed on the belt 66 is transferred to the paper P by an image transfer device 68.

Figure 5:
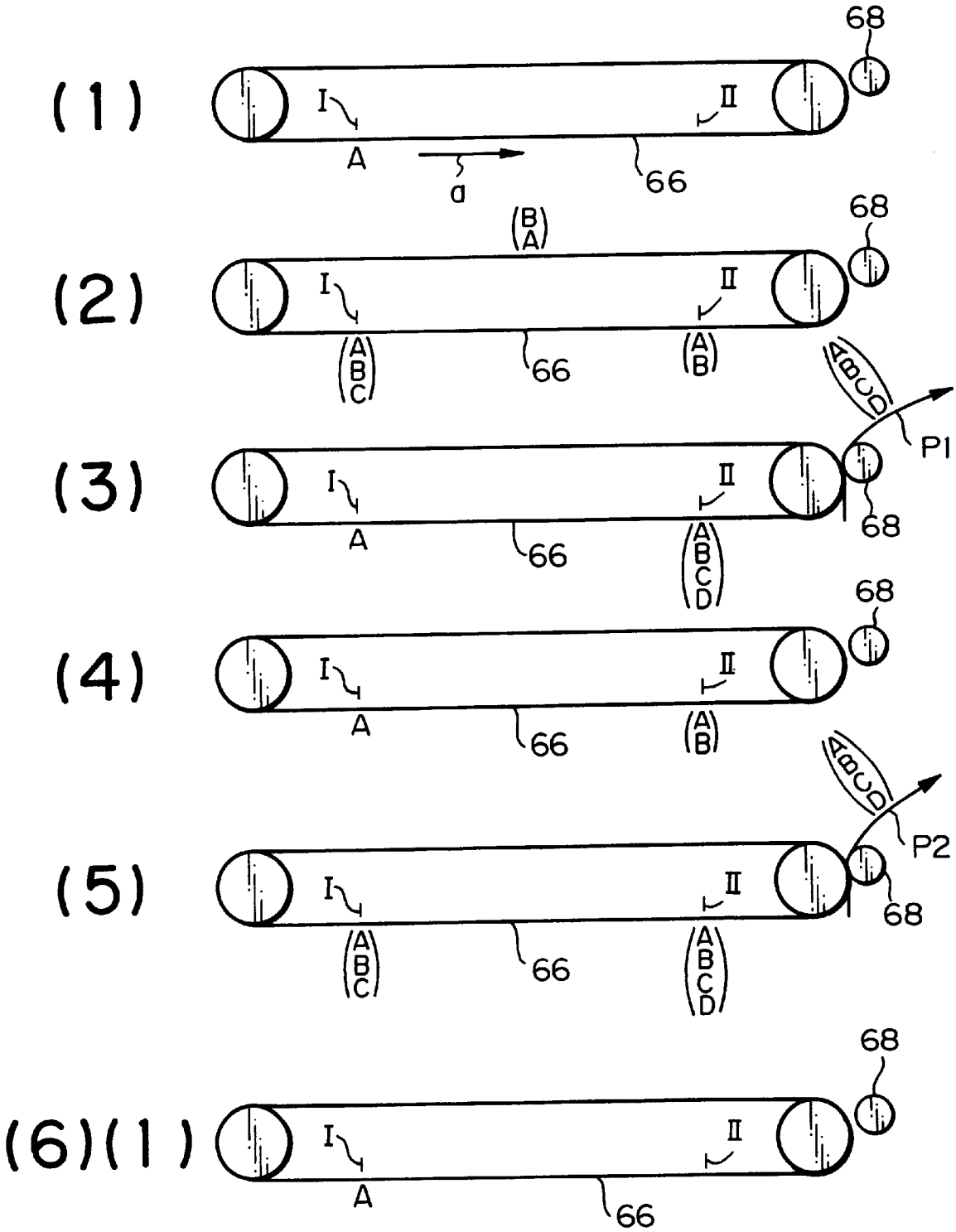
FIGS. 5 and 6 each shows a specific color image forming procedure particular to the second embodiment.
Figure 6:
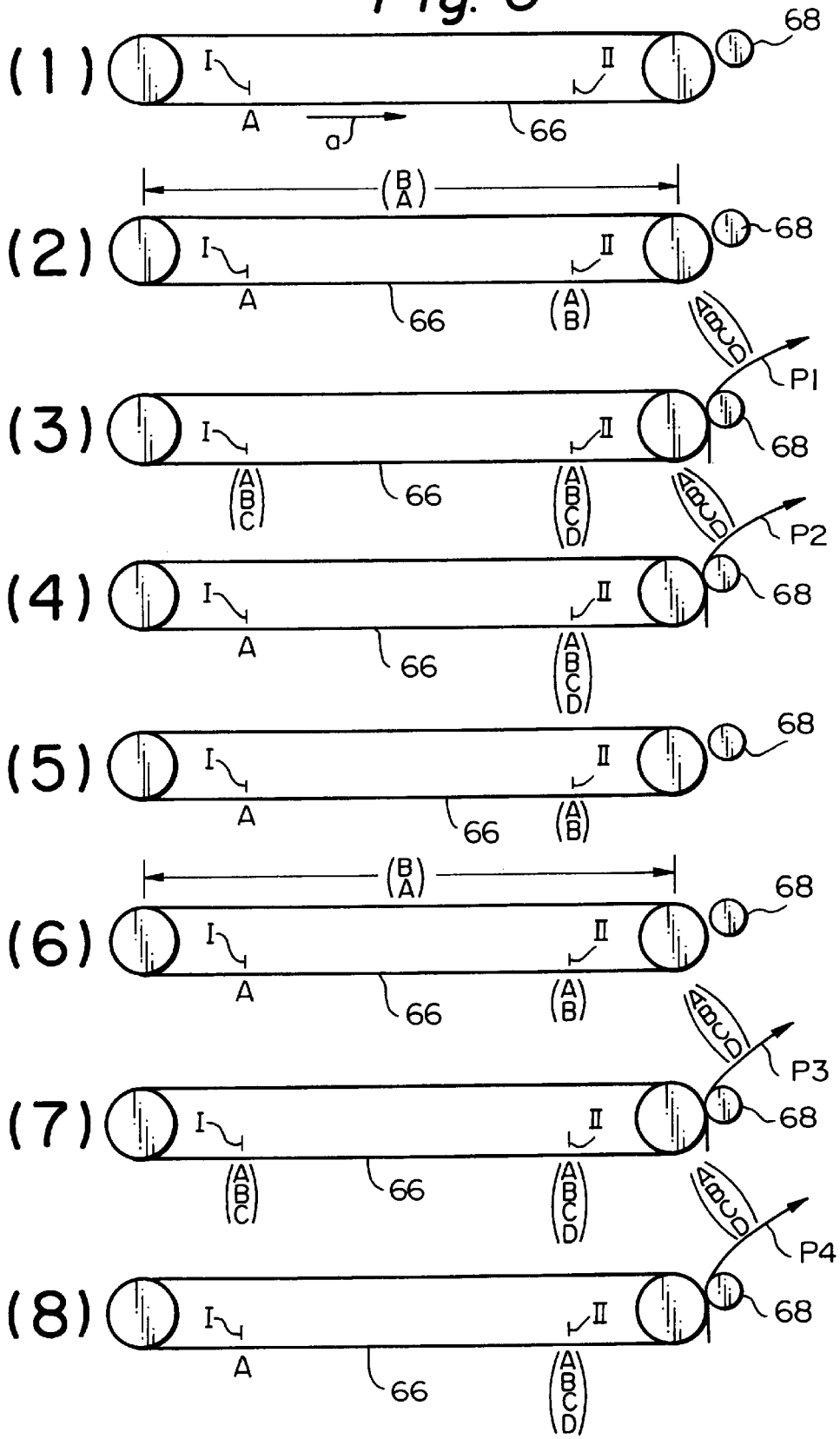

Assume that the belt 66 has a length L, and that the paper P has a length l in the direction of its movement at the time of image transfer. FIG. 5 demonstrates a color image forming procedure to occur when $L=l+\alpha$ holds while FIG. 6 shows a color image forming procedure to occur when $L=2(l+\alpha)$ holds. In FIGS. 5 and 6, $\alpha$ is representative of the length of a non-image area on the belt 66, as measured in the direction of movement of the belt 16, and is assumed to be smaller than 1. It is to be noted that the length $\alpha$ depends on the length of the image area on the belt 66 or the length of the paper P, and may therefore be greater than 1, depending on the length of the paper P.

As shown in FIG. 5, when $L=1+\alpha$ holds, the color image forming procedure consists of the following steps (1) through (6).

(1) The first image forming unit I having an A color developing device transfers an A color toner image to the belt 66.

(2) The second image forming unit II transfers a B color toner image to the belt 66 over the A color toner image to thereby form an A/B toner image. Then, the image forming unit I transfers a C color toner image to the belt 66 over the A/B toner image, thereby producing an A/B/C toner image. At this time, the belt 66 completes substantially one full turn.

(3) The image forming unit II transfers a D color (black) toner image to the belt 66 over the A/B/C toner image to thereby complete a full-color image. The full-color image is transferred from the belt 66 to a paper P1 by the image transfer device 68. The image transfer to the paper P1 occurs while the belt 66 is in the second turn.

(4) When a plurality of color printings are desired, the image forming unit I transfers an A color toner image to the belt 66 at the same time as the image forming unit II transfers the D color toner image in the above step (3). Then, the image forming unit II transfers a B color toner image over the A color toner image so as to form an A/B toner image.

(5) The image forming unit I transfers a C toner image over the A/B toner image produced in the step (4), and then the image forming unit II transfers a D color toner image over the resulting A/B/C toner image. The resulting full-color image is transferred to the second paper P2. This image transfer to the paper P2 occurs while the belt 66 in the fourth turn.

(6) The third printing is produced during the sixth turn of the belt 66 by the step (3) and successive steps.

As shown in FIG. 6, when $L/2=l+\alpha$ holds, the color image forming procedure consists of the following steps (1) through (8).

(1) The first image forming unit I transfers an A color toner image to the belt 66.

(2) While the image forming unit I transfers the next A color toner image to the belt 66, the second image forming unit II transfers a B color toner image to the belt 66 over the preceding A color toner image to thereby form an A/B toner image. At this instant, the belt 66 substantially completes one full turn.

(3) The image forming unit I transfers a C color toner image to the belt 66 over the A/B toner image formed in the step (2), thereby producing an A/B/C toner image. The image forming unit II transfers a D color (black) toner image to the belt 66 over the A/B/C toner image. The resulting full-color image is transferred to the paper P1 by the image transfer unit 68. The transfer of this full-color image begins when the belt 66 substantially completes one and half turns.

(4) Assume that a plurality of color copies are desired. Then, while the image forming unit I formed the A/B/C toner image in the step (3) forms the next A color toner image, the image forming unit II transfers a D color toner image to the belt 66 over the A/B/C toner image. The resulting full-color image is transferred to the second paper P2. The image transfer to the second paper P begins when the belt 66 substantially completes two and half turns.

(5) The image forming unit II transfers a B color toner image over the A color toner image formed on the belt 66 by the image forming unit I in the step (4).

(6) While the image forming unit I transfers the subsequent A color toner image to the belt 66, the image forming unit II transfers a B color toner image over the A color toner image formed in the step (4), thereby forming an A/B toner image.

(7) The image forming unit I transfers a C color toner image to the belt 66 over the A/B toner image formed in the step (6) so as to to form an A/B/C toner image. The image forming unit II transfers a D color toner image over the A/B/C toner image. The resulting color image is transferred to the third paper P3. This image transfer occurs when the belt 66 substantially completes three and half turns.

(8) While the image forming unit I transfers an A color toner image to the belt 66, the image forming unit II transfers a C color toner image over the A/B/C toner image formed in the step (7). The resulting color image is transferred to the fourth paper P4. This occurs when the belt 66 substantially completes four and half turns.

As stated above, when the belt 66 has a length more than twice as great as the length of the paper P, the first printing is produced by two turns of the belt 66, the second printing is produced by three turns of the belt, the third printings is produced by four turns of the belt, and so forth. That is, the n-th (n being 1 or greater integer) printing begins to be produced when the belt 66 makes n plus about 0.5 turns, and is fully produced when the belt 66 makes n plus one turns.

Figure 7:
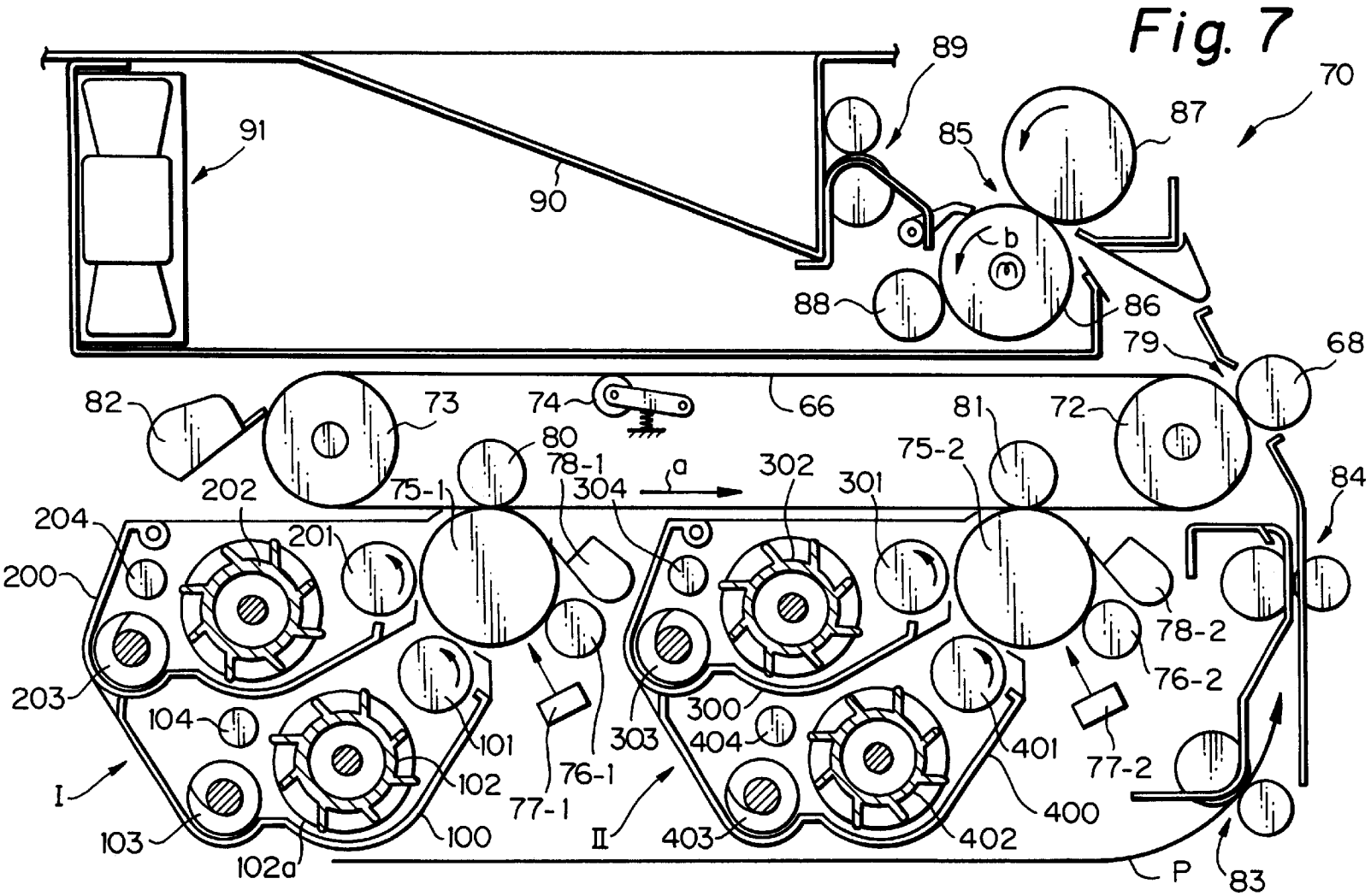
FIG. 7 shows the general construction of an image forming apparatus for practicing the second embodiment.

Referring to FIG. 7, a color image forming apparatus for practicing the second embodiment is shown. As shown, the apparatus, generally 70, includes the belt 66 passed over a drive roller 72 and a driven roller 73 and rotatable in the direction indicated by an arrow a. A tension roller 74 applies an adequate tension to the belt 66. The first and second image forming units I and II are arranged below the lower run of the belt 66 and spaced from each other by a predetermined distance. The belt 66 is longer than the paper P of maximum size, as measured in the direction of movement, applicable to the apparatus 70 by an amount corresponding to a non-image area.

The first image forming unit I includes a charger 76-1 for uniformly charging the surface of a drum 75-1, a writing unit 77-1 for scanning the charged surface of the drum 75-1 with a beam in accordance with an image signal, an A color developing device 100, a C color developing device 200, and a cleaning device 78-1.

The A color developing device 100 has a developing roller 101, a paddle roller 102, a screw conveyor 103, and an opening 104 for replenishing a developer. The paddle roller 102 is provided with a screw-like fin 102*a*. While the paddle roller 102 is in rotation, it conveys a developer stored in the developing device 100 in its axial direction while agitating the developer. The developer is fed to the developing roller 101. The screw conveyor 103 conveys the developer in the developing device 100 in the opposite direction to the paddle roller 102. As a result, the developer is fed to the developing roller 101 in a sufficiently agitated condition. A toner container, not shown, is removably mounted to the opening 104. The A toner is replenished from the toner container to one end of the screw conveyor 103 via the opening 104 at an adequate timing, so that the toner content of the developer in the developing device 100 is maintained constant.

Likewise, the C developing device 200 has a developing roller 201, a paddle roller 202, a screw conveyor 203 and an opening 204.

Figure 8:
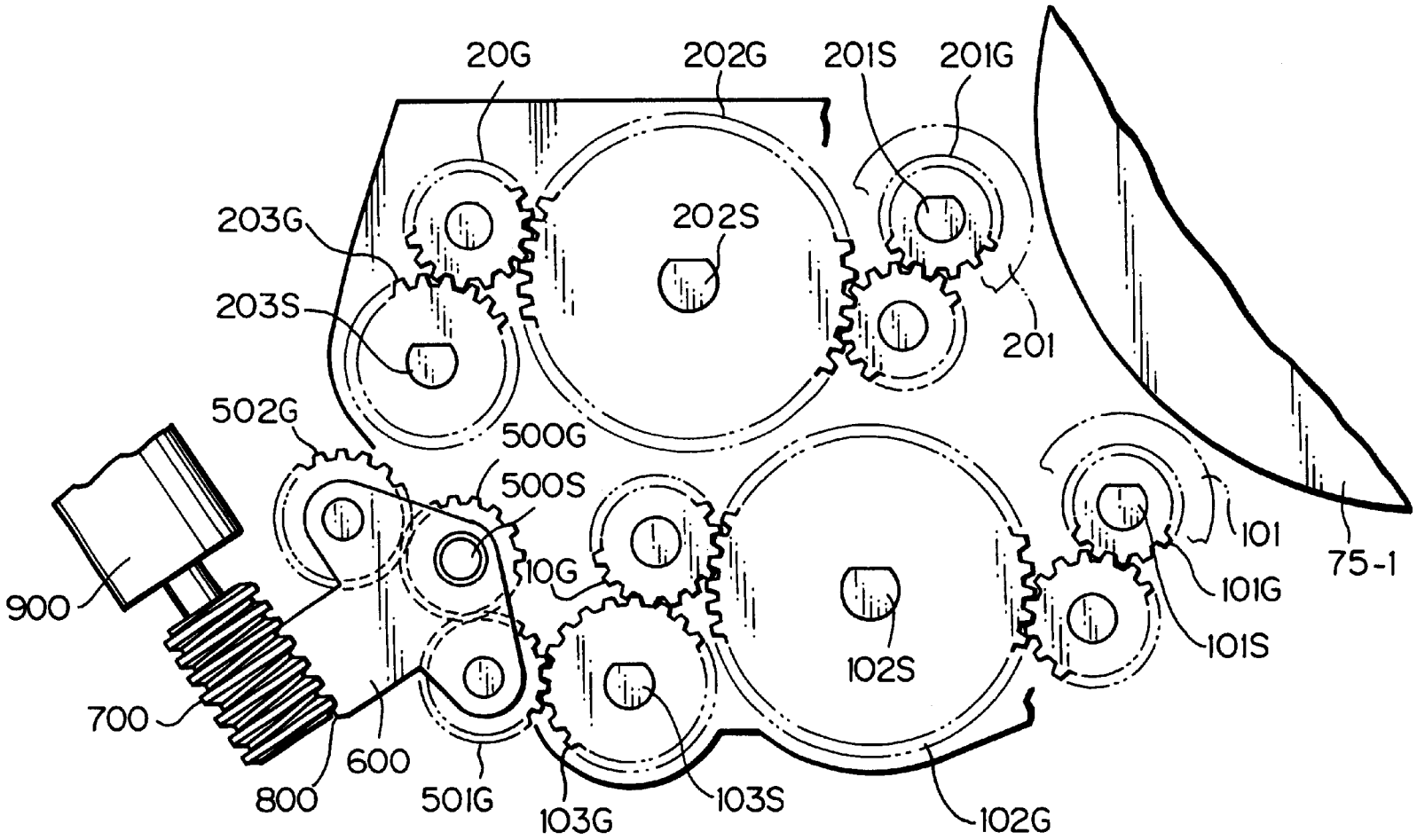
FIG. 8 shows a specific drive transmission mechanism included in the second embodiment.

As shown in FIG. 8, the paddle roller 102 and screw conveyor 103 of the A color developing device 100 are mounted on shafts 102S and 103S, respectively. Gears 102G and 103G are respectively mounted on the shafts 102S and 103S at the outside of one end plate of the developing device 100. The gears 102G and 103G are held in mesh with an intermediate idle gear 10G. Likewise, a gear 101G is mounted on the shaft 101S of the developing roller 101. The gears 101G and 102G are held in mesh with an intermediate idle gear (no numeral).

As also shown in FIG. 8, the paddle roller 202 and screw conveyor 203 included in the C developing device 200 are mounted on shafts 202S and 203S. Gears 202G and 203G are respectively affixed to the shafts 202S and 203S and held in mesh with an intermediate idle gear 20G. Likewise, the paddle rollers 202 and developing roller 201 are respectively mounted on shafts 202S and 201S. Gears 202G and 201G are respectively affixed to the shafts 202A and 201S and held in mesh with an intermediate idle gear (no numeral).

The gears 103G and 203G driven by a drive source drive the developing rollers 101 and 201, respectively, in the direction indicated by arrows in FIG. 7. As shown in FIG. 8, a drive shaft 500S is connected to a motor, not shown, playing the role of the drive source mounted on the apparatus body. A drive gear 500G is affixed to the drive shaft 500S while a pair of switching gears 501G and 502G are held in constant mesh with the drive gear 500G. The switching gears 501G and 502G are journalled to a support plate 600 which is pivotally mounted on the drive shaft 500S. When the support plate 600 is rotated about the drive shaft 500S, either one of the switching gears 501G and 502G is brought into mesh with the adjoining gear 103G or 203G, causing the developing roller 101 or 201 to rotate. In the specific condition shown in FIG. 8, the switching gear 501G is held mesh with the gear 103G and causes the developing roller 101 to rotate.

Specifically, a worm 700 is mounted on the output shaft of a motor 900. The support plate 600 is formed with teeth 800 meshing with the worm 700. When the worm 700 is rotated in either direction by the motor 900, it causes the support plate 600 to rotate via the teeth 800.

The second image forming unit II shown in FIG. 7 is identical in construction with the first image forming unit II and includes a drum 75-2, a writing device 77-2, a B color developing device 300, a D color developing device 400, and a cleaning device 78-2. The image forming unit II is mounted to the apparatus body in the same position as the image forming unit I. A drive transmission mechanism identical with the mechanism described with reference to FIG. 8 is also assigned to the image forming unit II.

The image forming units I and II are removably mounted to the apparatus body. The drums 75-1 and 75-2 are driven in synchronism with the movement of the belt 66 and have a peripheral speed precisely equal to the running speed of the belt 66. The chargers 76-1 and 76-2 may be replaced with corona chargers or charging devices using brushes, if desired.

The A color developing device 100 and C color developing device 200 of the first developing unit I store magenta toner and cyan toner, respectively. The B color developing device 300 and D color developing device 400 of the second developing unit II positioned closer to an image transfer position 79 than the first unit I stores yellow toner and black toner, respectively.

The black toner is used not only in a color mode but also in a black-and-white mode. Therefore, the D color developing device 400 should preferably be mounted on the second image forming unit II closer to the image transfer position than the first unit I, so that the copying speed can be increased in the black-and-white mode.

The yellow toner whose contrast to white of the paper P is low, i.e., whose luminosity is low is consumed more than the other toners except for the black toner. On the other hand, the black toner is used frequency, and therefore in a great amount, for black-and-white copies. Therefore, for a toner container having a given volume, the yellow toner and black toner are replenished at substantially the same timing. In this sense, if the developing devices storing the yellow toner and black toner, respectively, are mounted on the second image forming unit II, they can be replaced at the same time. This promotes the convenient handling of the apparatus.

Latent images formed by the charges 76-1 and 76-2 and writing devices 77-1 and 77-2 on the drums 75-1 and 75-2 are developed by the associated developing rollers 101, 201, 301 and 401. The four developing devices 100, 200, 300 and 400 are identical in construction, and each may be implemented by, e.g., a color developing device taught in Japanese Patent Laid-Open Publication No. 8-160697.

A first and a second transfer roller 80 and 81, respectively, face the drums 75-1 and 75-2, respectively. The transfer rollers 80 and 81 are movable into and out of contact with the drums 75-1 and 75-2 with the intermediary of the belt 66. A bias voltage for image transfer is applied to each of the first and second transfer roller 80 and 81. The transfer roller 68 is movable into and out of contact with the drive roller 72 with the intermediary of the belt 66 and applied with a bias voltage for image transfer.

Usually, the drums 75-1 and 75-2 are slightly spaced below the belt 66 while the transfer rollers 80 and 81 are spaced above the belt 66. At the time of transfer of a toner image from the drum 75-1 or 75-2 to the belt 66, the transfer roller 80 and/or the transfer roller 81 presses the belt 66 against the drum 75-1 and/or the drum 75-2, as will be described specifically later.

The drive roller 73 and transfer roller 68 define the image transfer position 79 mentioned earlier. The transfer rollers 80 and 81 playing the role of image transfer devices may be replaced with corona dischargers or charging devices using brushes, if desired. A belt cleaning device 82 is movable into and out of contact with the driven roller 73 with the intermediary of the belt 66 so as to clean the surface of the belt 12.

A paper feed device, not shown, is located below the image forming units I and II in order to feed papers or similar recording media one by one to the right, as viewed in FIG. 7. A paper P fed from the sheet feed device is conveyed to the image transfer position 79 by a feed roller pair 83 and a registration roller pair 84. A fixing device 85 is disposed obliquely above the image transfer position 79 and made up of a heat roller 86 and a press roller 87. The heat roller 86 is rotated in the direction indicated by an arrow b while the press roller 87 is pressed against and rotated by the heat roller 86. A roller 88 may be pressed against the heat roller 86 in order to apply an anti-offset liquid to the roller 86.

An outlet roller pair 89 is positioned downstream of the fixing device 85 in the direction in which the paper P is conveyed. The paper P coming out of the fixing unit 85 is discharged to a tray 90 by the outlet roller pair 89. A fan 91 for discharging heat is located above and at the left of the tray 90 in order to protect electronic parts positioned below the tray 90 from heat.

When $L=1+\alpha$ holds, the apparatus 70 executes the following image forming steps (1) through (4).

(1) The charger 76-1 and writing device 77-1 of the first image forming unit I form a latent image meant for the A color developing device 100 on the drum 75-1. The developing device 100 develops the latent image with magenta toner to thereby form a magenta toner image (M image hereinafter). The M image is transferred from the drum 75-1 to the belt 66 by the transfer roller 80.

(2) While the belt 66 moving in the direction a conveys the M image toward the second image forming unit II, the charger 76-2 and writing device 77-2 form a latent image meant for the B color developing device 300. The developing device 300 develops this latent image to thereby produce a yellow toner image (Y image hereinafter). The Y image is transferred to the belt 66 over the M image by the transfer roller 81.

(3) While the composite M/Y image approaches the image forming unit I due to the movement of the belt 66, the charger 76-1 and writing device 77-1 form a latent image meant for the C color developing device 200. The developing device 200 develops this latent image to thereby produce a cyan toner image (C image hereinafter). The C image is transferred to the belt 66 over the M/Y image by the transfer roller 80.

(4) While the composite M/Y/C image approaches the image forming unit II due to the movement of the belt 66, the charger 76-2 and writing device 77-2 form a latent image meant for the D color developing device 400. The developing device 400 develops this latent image to thereby produce a black toner image (Bk image hereinafter). The Bk image is transferred to the belt 66 over the M/Y/C image by the transfer roller 81.

When the resulting M/Y/C/Bk or full-color image is about to be formed on the belt 66 by the transfer roller 81, the paper P fed from the paper feed device is driven by the registration roller pair 84 to the image transfer position 79. As a result, the full-color image is transferred from the belt 66 to the paper P.

After the image on the paper P has been fixed by the fixing device 85, the paper P is driven out to the tray 90 by the outlet roller pair 89. The belt cleaning device 82 removes the toner left on the belt 66 after the image transfer.

Assume that a plurality of printings are desired. Then, when the M/Y image is transferred to the belt 66 by the second image forming unit II, the first image forming unit I transfers the next M image to the belt 66. This is followed by the above sequence of steps (1) through (4).

While any one of the developing rollers 101, 201, 301 and 401 is rotating for developing the associated latent image formed don the drum 75-1 or 75-2, the other developing rollers are held in a halt. Each developing roller may be implemented by a nonmagnetic sleeve rotatable during image formation and a magnet disposed in the sleeve, as conventional.

While one developing roller is operating, the developers on the other developing rollers must be prevented from being transferred to the drums and mixed together. To meet this requirement, the magnets of the other or inoperative three rollers are slightly rotated in order to shift their poles with respect to the drums. Alternatively, the inoperative developing rollers may be moved away from the drums.

Figure 9:
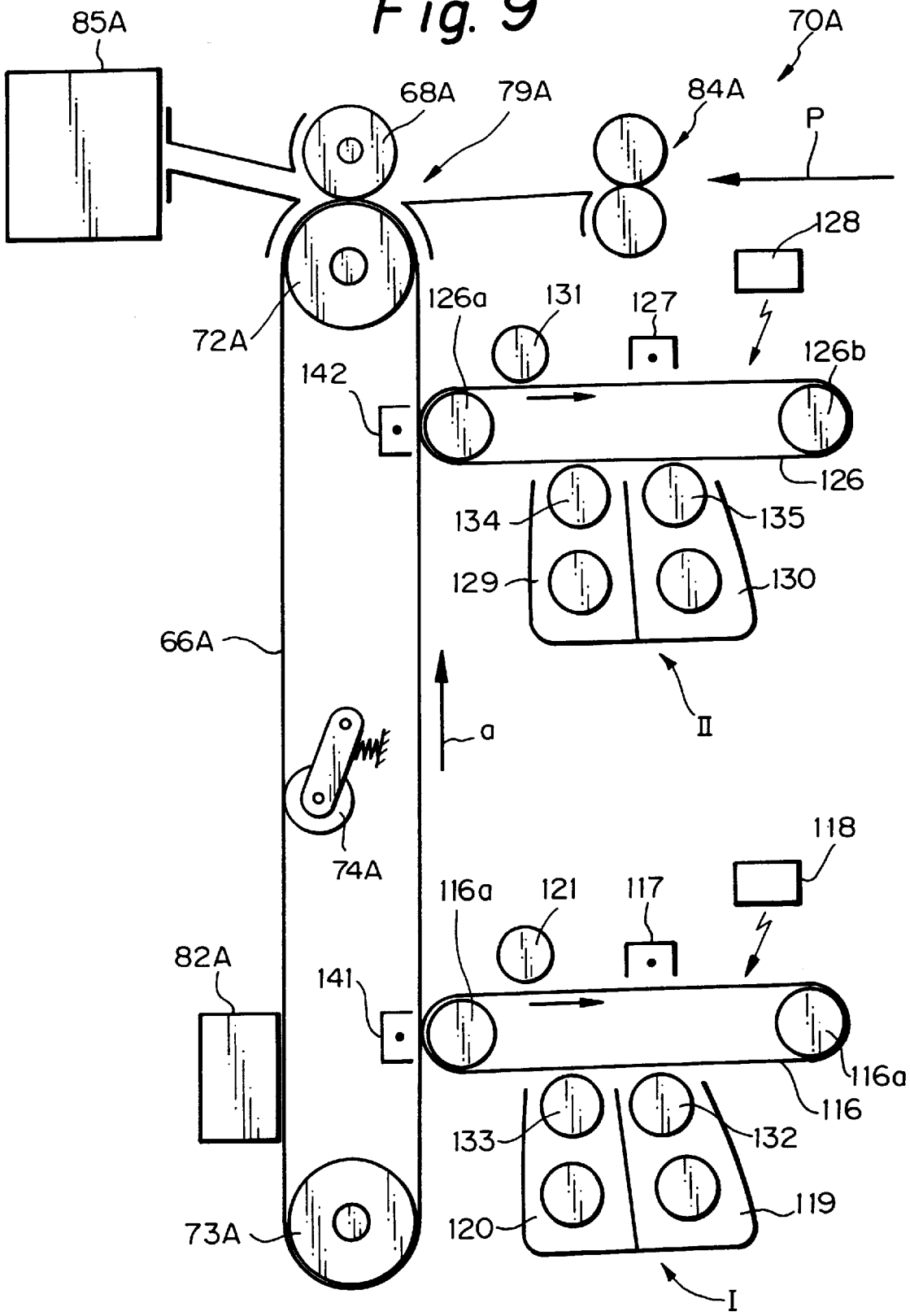
FIG. 9 shows a modification of the second embodiment.

FIG. 9 shows a modification of the second embodiment. As shown, an image forming apparatus, generally 70A, includes an intermediate transfer belt 66A passed over a drive roller 72A and a driven roller 73A which are positioned one above the other. The driven roller 72A causes the belt 66A to move in the direction indicated by an arrow a. A tension roller 74A applies an adequate tension to the belt 66A. The first and second image forming units I and II are arranged along the upward run of the belt 66A and spaced from each other by a predetermined distance. A belt cleaning device 82A is positioned above and at the right of the belt 66A, as viewed in FIG. 9, in order to remove toner to remain on the belt 66A after image transfer.

The first image forming unit I includes a charger 117 for uniformly charging the surface of a photoconductive belt (simply belt hereinafter) 116 which is another specific form of an image carrier. The charger 117 is implemented by a corona discharger. A writing device 118 scans the charged surface of the belt 116 with a beam in accordance with an image signal representative of a document image. Also included in the image forming unit I are an M developing unit 119, a C developing unit 120, and a cleaning device 121. The belt or image carrier 116 is passed over a drive roller 116*a* and a driven roller 116*b* spaced from each other in substantially the horizontal direction. The drive roller 116*a* causes the belt 116 to move in the direction indicated by an arrow.

The second image forming unit II is identical in construction with the first unit I and includes a photoconductive belt 126, a charger 127, a writing device 128, a Y developing device 129, a Bk developing device 130, and a cleaning device 131. The image forming unit II is mounted to the apparatus body in the same position as the image forming unit 1. The belt 126 is passed over a drive roller 126*a* and a driven roller 126*b* and driven by the drive roller 126*a* in the direction indicated by an arrow.

The image forming units I and II each is removably mounted to the apparatus body. The rotation of the belts 116 and 126 are synchronous to the movement of the belt 66A and have a peripheral speed precisely equal to the moving speed of the belt 66A.

The M, C, Y and Bk developing units 119, 120, 129 and 130 store magenta toner, cyan toner, yellow toner and black toner, respectively. The charger 117 and writing device 118 and the charger 1278 and writing device 128 each forms a latent image on the respective belt 116 or 126. The latent images on the belts 116 and 126 are selectively developed by the developing rollers 132, 133, 134 and 135. The developing devices 119, 120, 129 and 130 are identical in configuration, and each includes a respective agitator and a toner replenishing device.

A first and a second transfer charger 141 and 142 respectively face the belts 116 and 126 with the intermediary of the belt 66A. A transfer roller 68A is movable into and out of contact with the drive roller 72A with the intermediary of the belt 66A and is applied with a bias voltage for image transfer. The drive roller 72A and transfer roller 68A define an image transfer position 79A.

When $L=1+\alpha$ holds, this modification forms a color image in the same manner as in the second embodiment.

In the second embodiment and its modification, the developing units each having the respective drum and developing device are identical in configuration and arranged along a single run of the intermediate transfer belt at the same intervals. In addition, all the image forming units are mounted to the apparatus body in the same position as each other. Therefore, so long as such image forming units are identical in position, the above plane of the belt may not be horizontal, but may be vertical or even inclined, as desired.

A reading device for reading a document will be used when any one of the embodiment and its modification is applied to an electrophotographic copier, although not shown in the drawings.

Gold toner, silver toner, flesh-color toner and fluorescent color toner, for example, may be used in addition to the three primary color toners and black toner, if desired. For example, assume that the first image forming unit stores yellow toner, cyan toner, and flesh-color toner while the second image forming unit stores magenta toner, black toner, and gold toner. Then, the two image forming units I and II will each be provided with three developing devices; the yellow toner and flesh-color toner of the unit I and the black toner of the unit II will be selectively used to form a color image.

As stated above, the second embodiment and its modification prevent the image forming apparatus from being increased in size, increase the number of copies or printings for a unit time, and reduce the number of image forming process units. In addition, because two image forming units are identical in construction, the apparatus is extremely easy to produce, assemble, and maintain.

Various modifications will become possible for those skilled in the art after receiving the teachings of the present disclosure without departing from the scope thereof.

What is claimed is:

1. A multicolor image forming apparatus comprising:

at least first and second image forming means spaced from each other by a preselected distance, said first image forming means including a first image carrier and first developing means for developing a latent image electrostatically formed on said first image carrier by use of a developer of first color, said second image forming means including a second image carrier and second developing means for developing a latent image electrostatically formed on said second image carrier by use of a developer of second color;

an intermediate transfer belt to which toner images respectively formed on said first and second image carriers by said first and second developing means are transferred, said first and second imge forming means being arranged below and along a single run of said intermediate transfer belt; and transferring means for transferring the toner images from said intermediate transfer belt to a recording medium.

2. A multicolor image forming apparatus comprising:

at least two image forming means spaced from each other by a preselected distance, and each including an image carrier, charging means for uniformly charging a surface of said image carrier, latent image forming means for electrostatically forming a latent image on said surface of said image carrier charged, developing means for developing said latent image, and cleaning means for cleaning said image carrier;

an intermediate transfer belt to which toner images formed by said developing means of said at least two image forming means are transferred, said at least two image forming means being arranged below and along a single run of said intermediate transfer belt; and transferring means for transferring the toner images from said intermediate transfer belt to a recording medium;

wherein said at least two image forming means are identical in construction, and able to be arranged in a same position in a direction in which the single run of said intermediate transfer belt moves, and are removably mounted to a body of said apparatus.

3. An image forming method for forming each of toner images of at least three primary colors A, B and C on a respective image carrier, transferring said toner images to an intermediate transfer belt, and transferring said toner images from said intermediate transfer belt to a recording medium, said method comprising the steps of:

preparing first and second image forming means arranged below and along a single run of said intermediate transfer belt and spaced from each other by a preselected distance;

causing said first image forming means to transfer an A color toner image to said intermediate transfer belt;

causing said second image forming means to transfer a B color toner image to said intermediate transfer belt over said A color toner image;

causing said first image forming means to transfer a C color toner image to said intermediate transfer belt over a resulting A/B color toner image to thereby form a color image; and causing transferring means to transfer the color image to a recording medium.

4. A method as claimed in claim 3, wherein after said first image forming means has transferred the C color toner image over the A/B color toner image, said second image forming means transfers a black toner image over a resulting A/B/C color toner image.

5. A method as claimed in claim 3, wherein the A color, the B color and the C color are magenta or cyan, cyan or magenta, and yellow, respectively.

6. An image forming method for forming each of toner images of at least three primary colors A, B and C on a respective image carrier, transferring said toner images to an intermediate transfer belt, and transferring said toner images from said intermediate transfer belt to a recording medium, said method comprising the steps of:

preparing first and second image forming means arranged below and along a single run of said intermediate transfer belt and spaced from each other by a preselected distance;

causing said first image forming means to transfer an A color toner image to said intermediate transfer belt;

causing said second image forming means to transfer a B color image to said intermediate transfer belt over the A color toner image while causing said first image forming means to transfer a subsequent A color toner image to said intermediate transfer belt;

causing said first image forming means to transfer a C toner image to said intermediate transfer belt over a resulting A/B color toner image to thereby form a color image; and causing transferring means to transfer the color image from said intermediate transfer belt to a recording medium.

7. A method as claimed in claim 6, wherein after said first image forming means has transferred the C color toner image over the A/B color toner image, said second image forming means transfers a black toner image over a resulting A/B/C color toner image.

8. A method as claimed in claim 6, wherein the A color, the B color and the C color are magenta or cyan, cyan or magenta, and yellow, respectively.

9. An image forming apparatus comprising:

a first and a second image forming unit spaced from each other by a preselected distance, said first image forming unit including a first image carrier and first developing means for developing a latent image electrostatically formed on said first image carrier by use of at least two developers of different colors, said second image forming unit including a second image carrier and second developing means for developing a latent image electrostatically formed on said second image carrier by use of a developer of color different from the colors of said at least two developers;

an intermediate transfer belt to which toner images formed by said first and second developing means are transferred, said first and second image forming units being arranged below and along a single run of said intermediate transfer belt; and transferring means for transferring the toner images from said intermediate transfer belt to a recording medium.

10. An apparatus as claimed in claim 9, wherein the A color, the B color and the C color are magenta or cyan, cyan or magenta, and yellow, respectively.

11. An image forming apparatus comprising:

a first and a second image forming unit spaced from each other by a preselected distance, said first image forming unit including a first image carrier, A color developing means for developing a latent image electrostatically formed on said first image carrier by use of an A color developer, and C color developing means for developing the latent image by use of a C color developer, said second developing unit including a second image carrier, and B color developing means for developing a latent image electrostatically formed on said second image carrier by use of a B color developer;

an intermediate transfer belt to which toner images formed by said A color developing means, said C color developing means and said C color developing means are transferred, said first and second image forming units being arranged below and along a single run of said intermediate transfer belt; and transferring means for transferring the toner images from said intermediate transfer belt to a recording medium.

12. An image forming apparatus comprising:

an intermediate transfer belt passed over rollers such that a surface thereof to which a toner image formed in at least three primary colors A, B and C is to be transferred substantially faces downward;

a first and a second photoconductive drum sequentially arranged below and in a direction in which said surface of said intermediate transfer belt moves, for each electrostatically forming a respective latent images thereon;

A color developing means for developing the latent image formed on said first photoconductive drum by use of A color toner;

C color developing means for developing the latent image formed on said second photoconductive drum by use of C color toner;

B color developing means for developing the latent image formed on said second photoconductive drum by use of B color toner;

transferring means located downstream of, but close to, said second photoconductive drum in a direction of movement of said intermediate transfer belt for transferring a resulting color image from said intermediate transfer belt to a recording medium;

a transport path for feeding the recording medium from feeding means upward toward said transferring means; and a fixing device positioned above said intermediate transfer belt for fixing the color image transferred to the recording medium.

13. An image forming apparatus comprising:

an intermediate transfer belt passed over rollers such that an surface thereof to which a toner image formed in at least three primary colors A, B and C is to be transferred substantially faces downward;

a first and a second photoconductive belt sequentially arranged in a direction in which said surface of said intermediate transfer belt moves, for each electrostatically forming a respective latent images thereon;

A color developing means for developing the latent image formed on said first photoconductive belt by use of A color toner;

C color developing means for developing the latent image formed on said second photoconductive belt by use of C color toner;

B color developing means for developing the latent image formed on said second photoconductive belt by use of B color toner; and transferring means located downstream of, but close to, said second photoconductive belt in a direction of movement of said intermediate transfer belt for transferring a resulting color image from said intermediate transfer belt to a recording medium.

14. A multicolor image forming apparatus comprising:

at least first and second image forming devices spaced from each other by a preselected distance, said first image forming device including a first image carrier and first developing unit for developing a latent image electrostatically formed on said first image carrier by use of a developer of first color, said second image forming device including a second image carrier and second developing unit for developing a latent image electrostatically formed on said second image carrier by use of a developer of second color;

an intermediate transfer belt to which toner images respectively formed on said first and second image carriers by said first and second developing units are transferred, said first and second image forming devices being arranged along a single run of said intermediate transfer belt; and a transferring device for transferring the toner images from said intermediate transfer belt to a recording medium.

15. An apparatus as claimed in claim 14, wherein one of said first and second developing units stores a black developer.

16. An apparatus as claimed in claim 14, wherein said first and second image carriers each comprises a photoconductive element in a form of a drum or a belt.

17. An apparatus as claimed in claim 14, wherein said first and second image forming devices are identical and arranged with the same orientation relative to the single run of said intermediate transfer belt, wherein said first and second image forming devices are removably mounted to a body and are replaceable with each other.

18. An apparatus as claimed in claim 14, wherein said first and second image forming devices are each removable from a body of said apparatus.

19. An apparatus as claimed in claim 14 wherein said first and second image forming devices are of identical construction.

20. An apparatus as claimed in claim 14, wherein said first and second image forming devices are arranged at the same orientation along a direction in which the single run of said intermediate transfer belt moves.

21. An apparatus comprising:

at least two image forming devices spaced from each other by a preselected distance, and each including an image carrier, a charging unit for uniformly charging a surface of said image carrier, latent image forming devices for electrostatically forming a latent image on said surface of said charged image carrier, developing units for developing said latent image, and a cleaning unit for cleaning said image carrier;

an intermediate transfer belt to which toner images formed by said developing units of said at least two image forming devices are transferred, said at least two image forming devices being arranged along a single run of said intermediate transfer belt; and a transferring device for transferring the toner images from said intermediate transfer belt to a recording medium;

wherein said at least two image forming devices are identical in construction and arranged with the same orientation relative to the single run of said intermediate transfer belt, wherein said image forming devices are removably mounted to a body, wherein said image carrier comprises a photoconductive element in a form of a drum or a belt, and wherein said at least two image forming devices are replaceable with each other.

22. An image forming apparatus comprising:

a first and second image forming device spaced from each other by a preselected distance, said first image forming device including a first image carrier and first developing units for developing a latent image electrostatically formed on said first image carrier by use of at least two developers of different colors, said second image forming device including a second image carrier and second developing units for developing a latent image electrostatically formed on said second image carrier by use of a developer of color different from the colors of said at least two developers;

an intermediate transfer belt to which toner images formed by said first and second developing units are transferred, said first and second image forming devices being arranged below and along a single run of said intermediate transfer belt; and a transferring device for transferring the toner images from said intermediate transfer belt to a recording medium.

23. An apparatus as claimed in claim 22, wherein said intermediate transfer belt has a length at least twice as great as a length of a recording medium of minimum size adapted to a full-color image, as measured in a direction in which the recording medium is fed.

24. An apparatus as claimed in claim 22, wherein said first and second image forming devices are each removable from a body of said apparatus.

25. An apparatus as claimed in claim 22, wherein said first and second image forming devices are identical in construction.

26. An apparatus as claimed in claim 22, wherein said first and second image forming devices are each able to be arranged in a same position along a direction in which the single run of said intermediate transfer belt moves.

27. An apparatus as claimed in claim 22, wherein said first image forming device, said second image forming device and said transferring device are sequentially arranged in order in a direction in which the single run of said intermediate transfer belt moves, and wherein the developing unit storing toner to be used most frequently is mounted on said second image forming device.

28. An apparatus as claimed in claim 27, wherein the toner to be used most frequently is black toner.

29. An apparatus as claimed in claim 22, wherein said first image forming device, said second image forming device and said transferring device are sequentially arranged in order in a direction in which the single run of said intermediate transfer belt moves, and wherein the developing unit storing toner having a lowest luminosity is mounted on said second image forming device.

30. An apparatus as claimed in claim 29, wherein the toner having the lowest luminosity is yellow toner.

31. An apparatus as claimed in claim 22, wherein said first image forming device, said second image forming device and said transferring device are sequentially arranged in order in a direction in which the single run of said intermediate transfer belt moves, and wherein the developing unit storing toner to be used most frequently and the developing unit storing toner having a lowest luminosity are mounted on said second image forming device.

32. An apparatus as claimed in claim 31, wherein the toner to be used most frequently and the toner having the lowest luminosity are black toner and yellow toner, respectively.

33. An apparatus as claimed in claim 22, wherein the A color, the B color and the C color are one of magenta and cyan, and yellow, respectively.

34. An image forming apparatus comprising:

a first and a second image forming device spaced from each other by a preselected distance, said first image forming device including a first image carrier, an A color developing unit for developing a latent image electrostatically formed on said first image carrier by use of an A color developer and a C color developing unit for developing the latent image by use of a C color developer, said second image forming device including a second image carrier and a B color developing unit for developing a latent image electrostatically formed on said second image carrier by use of a B color developer;

an intermediate transfer belt to which toner images formed by said A color developing unit, said B color developing unit and said C color developing unit are transferred, said first and second image forming devices being arranged below and along a single run of said intermediate transfer belt; and a transferring device for transferring the toner images from said intermediate transfer belt to a recording medium.

35. An apparatus as claimed in claim 34, wherein said image carriers each comprise a photoconductive element formed of a drum or a belt.

36. An apparatus as claimed in claim 34, wherein said second image forming device includes a black developing unit for developing the latent image formed on said image carrier by use of black toner.

37. An apparatus as claimed in claim 34, wherein said intermediate transfer belt has a length at least twice as great as a length of a recording medium of minimum size adapted to a full-color image, as measured in a direction in which the recording medium is fed.

38. An apparatus as claimed in claim 34, wherein said first and second image forming devices are each removable from a body of said apparatus.

39. An apparatus as claimed in claim 34, wherein said first and second image forming devices are identical in construction.

40. An apparatus as claimed in claim 34, wherein said first and second image forming devices are arranged with the same orientation relative to the single run of said intermediate transfer belt.

41. An apparatus as claimed in claim 34, wherein said first image forming device, said second image forming device and said transferring device are sequentially arranged in order in a direction in which the single run of said intermediate transfer belt moves, and wherein the developing unit storing toner to be used most frequently is mounted on said second image forming unit.

42. An apparatus as claimed in claim 41, wherein the toner to be used most frequently is black toner.

43. An apparatus as claimed in claim 34, wherein said first image forming device, said second image forming device and said transferring device are sequentially arranged in order in a direction in which the single run of said intermediate transfer belt moves, and wherein the developing unit storing toner having a lowest luminosity is mounted on said second image forming device.

44. An apparatus as claimed in claim 43, wherein the toner having the lowest luminosity is yellow toner.

45. An apparatus as claimed in claim 34, wherein said first image forming device, said second image forming device and said transferring device are sequentially arranged in order in a direction in which the single run of said intermediate transfer belt moves, and wherein the developing unit storing toner to be used most frequently and the developing unit storing toner having a lowest luminosity are mounted on said second image forming device.

46. An apparatus as claimed in claim 45, wherein the toner to be used most frequently and the toner having the lowest luminosity are black toner and yellow toner, respectively.

47. An apparatus as claimed in claim 34, wherein the A color, the B color and the C color are one of magenta and cyan, and yellow, respectively.

48. An image forming apparatus comprising:

an image forming engine comprising at least two substantially identical image forming devices spaced from one another;

an intermediate transfer belt having a horizontal run extending above said image forming devices such that images formed by said image forming devices may be sequentially transferred to said transfer belt;

a paper feed section configured to feed paper to said intermediate transfer belt from below said image forming engine; and a paper discharge section configured to discharge paper from said intermediate transfer belt to above said intermediate transfer belt.

49. An image forming apparatus comprising:

image forming means comprising at least two substantially identical image forming devices for forming at least two color images;

an intermediate transfer belt having a horizontal run extending above said image forming devices such that images formed by said image forming devices may be sequentially transferred to said transfer belt;

paper feed means for feeding paper to said intermediate transfer belt from below said image forming means; and paper discharge means for discharging paper from said intermediate transfer belt to above said intermediate transfer belt.

* * * * *